US011261009B2

(12) United States Patent
Thorez et al.

(10) Patent No.: US 11,261,009 B2
(45) Date of Patent: Mar. 1, 2022

(54) REMOVABLE CAP FOR A DISPENSING BOTTLE

(71) Applicant: ALBEA SERVICES, Gennevilliers (FR)

(72) Inventors: Gael Thorez, Voisins le Bretonneux (FR); Laurent Pesqueux, Teloché (FR); Philippe Paris, Ecommoy (FR)

(73) Assignee: Albea Services, Gennevilliers (FR)

( * ) Notice: Subject to any disclaimer, the term of this patent is extended or adjusted under 35 U.S.C. 154(b) by 330 days.

(21) Appl. No.: 16/580,937

(22) Filed: Sep. 24, 2019

(65) Prior Publication Data

US 2020/0095025 A1 Mar. 26, 2020

(30) Foreign Application Priority Data

Sep. 24, 2018 (FR) ..... 1858680

(51) Int. Cl.
*B65D 41/28* (2006.01)
*B05B 11/00* (2006.01)
*B65D 47/00* (2006.01)

(52) U.S. Cl.
CPC ..... *B65D 41/28* (2013.01); *B05B 11/0032* (2013.01); *B65D 47/00* (2013.01); *B65D 2203/00* (2013.01)

(58) Field of Classification Search
CPC .... B65D 41/28; B65D 2203/00; B65D 47/00; B65D 5/4212; B65D 51/24; B65D 33/004; B05B 11/0023; B05B 11/3049
USPC ..... 220/212, 301, 62.14; 222/562; 215/328, 215/329, 341, 334–339
See application file for complete search history.

(56) References Cited

U.S. PATENT DOCUMENTS

| | | | | |
|---|---|---|---|---|
| 5,025,941 | A | 6/1991 | Petit | |
| 5,377,853 | A * | 1/1995 | Papciak | A61J 1/03 206/459.5 |
| 5,379,908 | A * | 1/1995 | Rohe | B65D 51/002 215/249 |
| 5,636,740 | A * | 6/1997 | Finkiewicz | B65D 47/0842 206/457 |
| 6,237,788 | B1 * | 5/2001 | Shuen | A61L 9/12 206/457 |
| 8,474,620 | B2 | 7/2013 | Mather | |
| 8,919,595 | B2 * | 12/2014 | Chae | B65D 47/063 220/315 |
| 9,045,036 | B2 * | 6/2015 | Mihara | B60K 15/035 |
| 10,077,142 | B1 * | 9/2018 | Buzot | B65D 47/128 |

(Continued)

FOREIGN PATENT DOCUMENTS

FR 3032694 8/2016

*Primary Examiner* — Lien M Ngo
(74) *Attorney, Agent, or Firm* — CRGO Global; Steven M. Greenberg

(57) ABSTRACT

A removable cap for a dispensing bottle of a fluid product, equipped with a central axis, includes an axis insert being capable of concealing a dispensing system of the bottle. The insert includes a peripheral portion and an upper portion, a first decorative element mounted on the insert and covering the peripheral portion of the insert, a second decorative element mounted on the insert and covering the upper portion of the insert. The second decorative element engages with the first decorative element so as to integrate decorative protrusions within the first decorative element, arranged on the periphery of the cap. The decorative protrusions are arranged on lugs.

16 Claims, 6 Drawing Sheets

(56) References Cited

U.S. PATENT DOCUMENTS

| | | | | |
|---|---|---|---|---|
| 10,934,062 | B2 * | 3/2021 | Tamarindo | B65D 41/3404 |
| 2006/0250795 | A1 * | 11/2006 | Langone | B65D 83/75 362/253 |
| 2010/0187196 | A1 * | 7/2010 | Wasenda | B65D 55/00 215/386 |
| 2010/0243599 | A1 * | 9/2010 | Chae | B65D 45/322 215/274 |
| 2015/0184687 | A1 * | 7/2015 | Weis | B60B 3/16 411/373 |
| 2016/0039584 | A1 | 2/2016 | Verderber | |
| 2019/0127121 | A1 | 5/2019 | Salcido Pinera | |
| 2019/0177054 | A1 * | 6/2019 | Duckworth | C12H 1/16 |

* cited by examiner

[Fig.1]
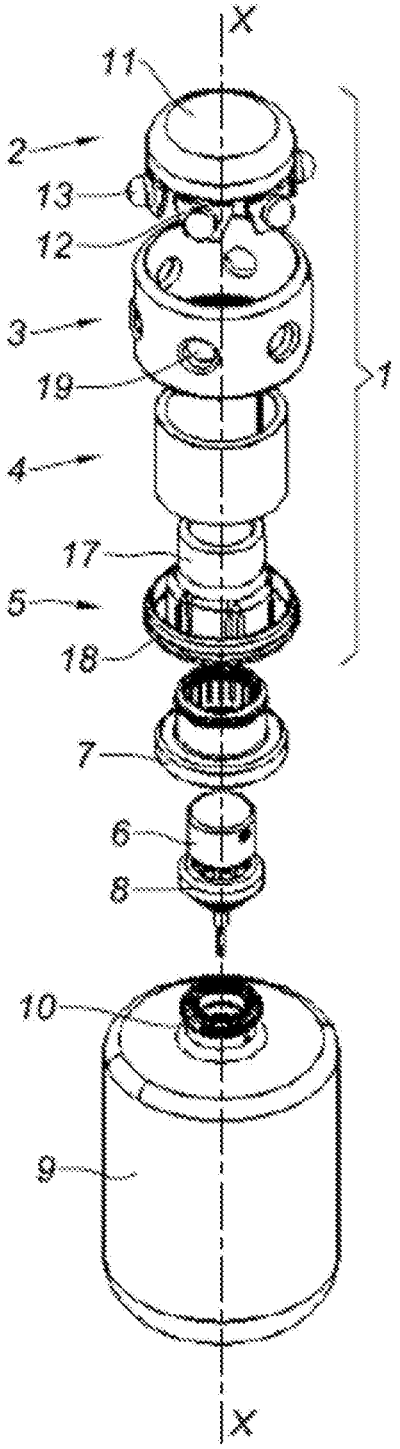

[Fig.2]
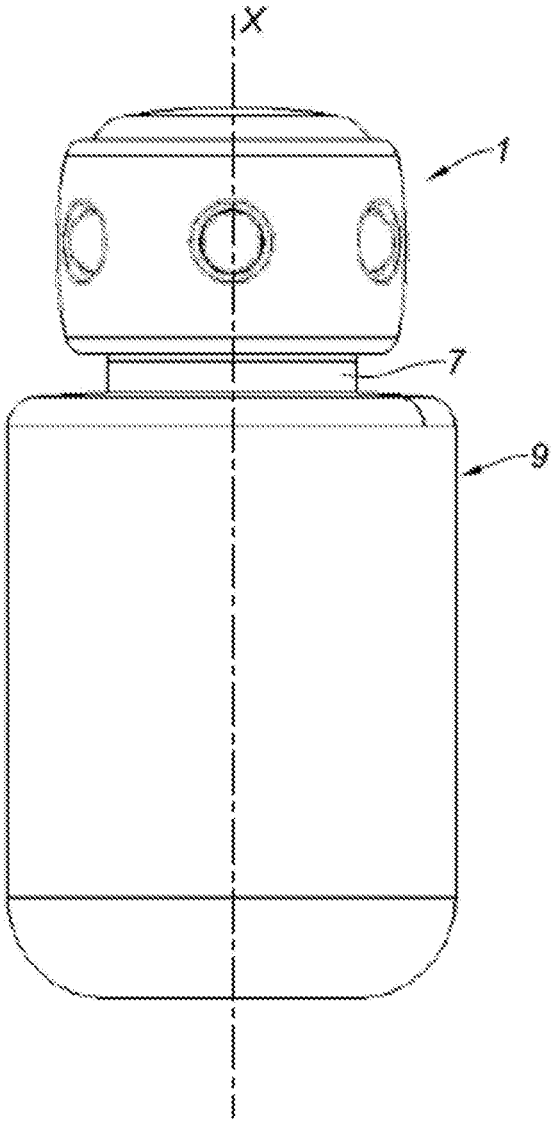

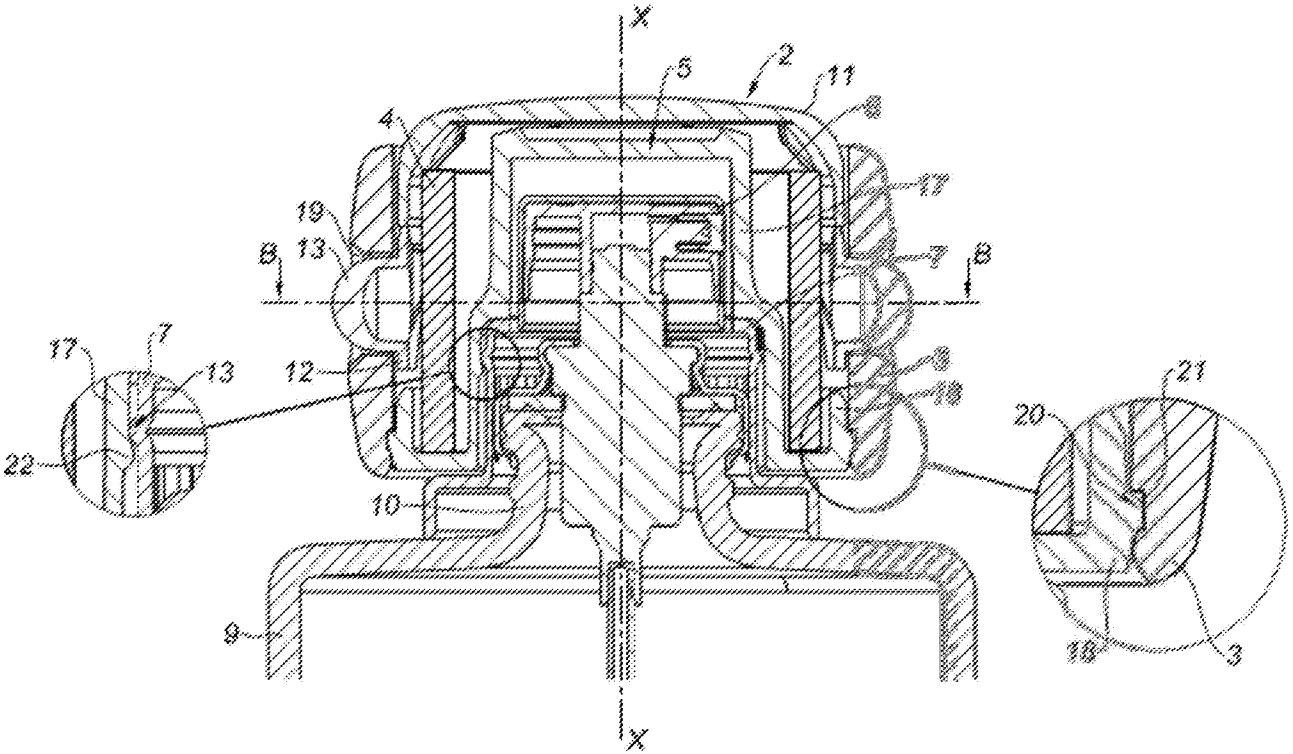
[Fig. 3]

[Fig.4]
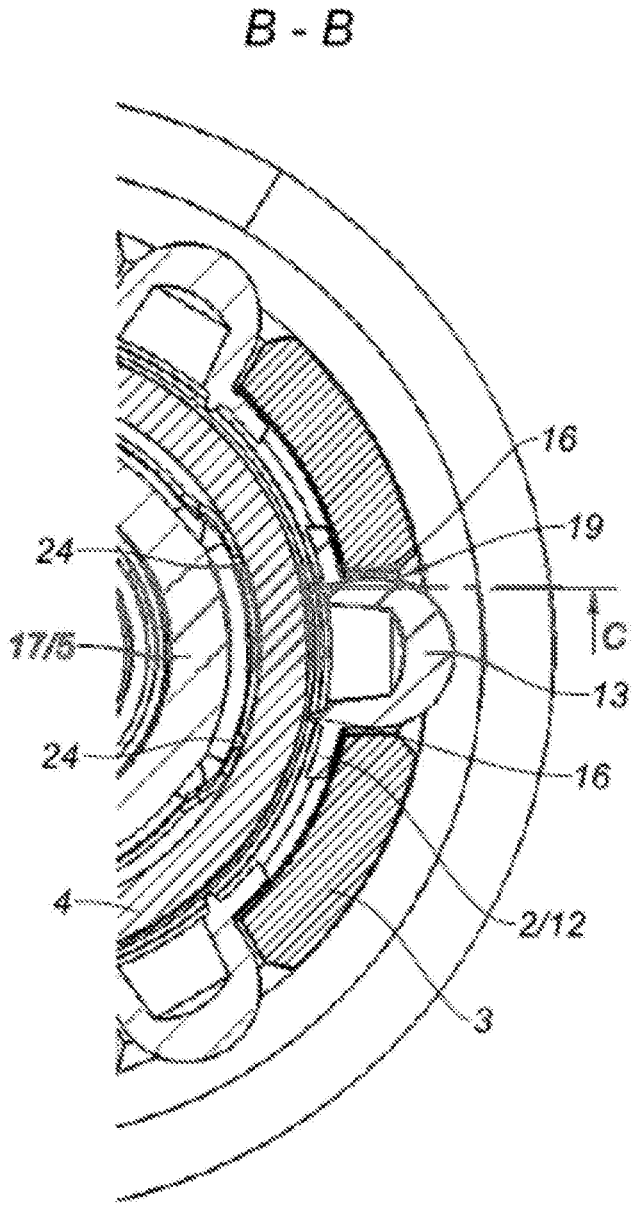

[Fig.5]
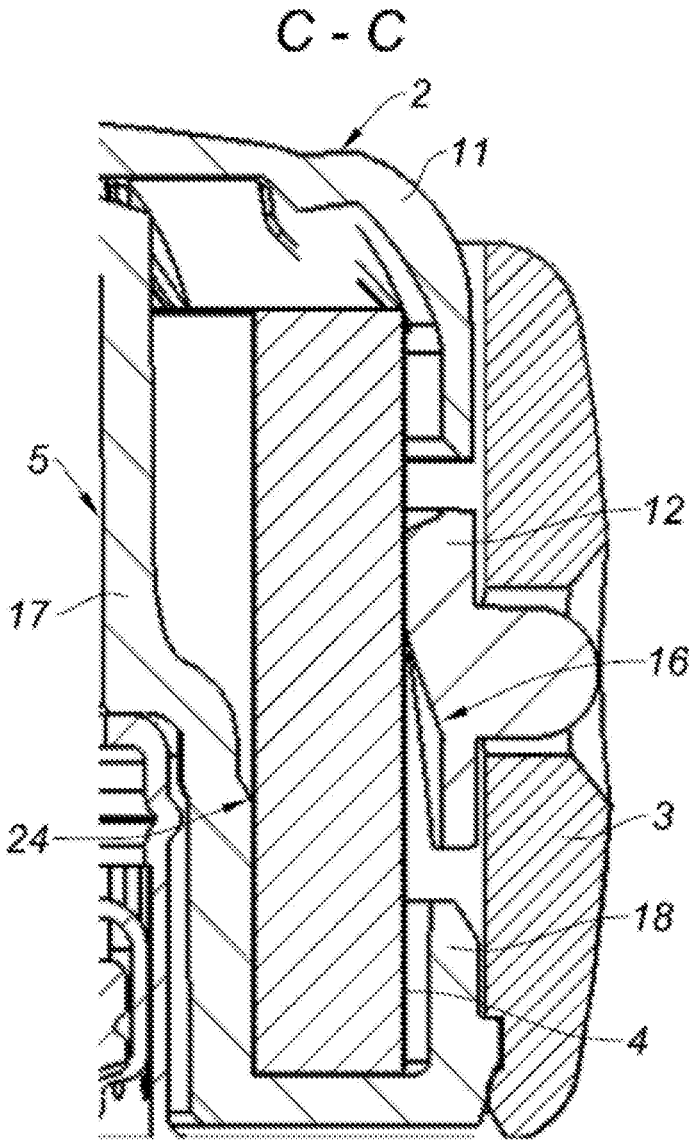

[Fig.6]
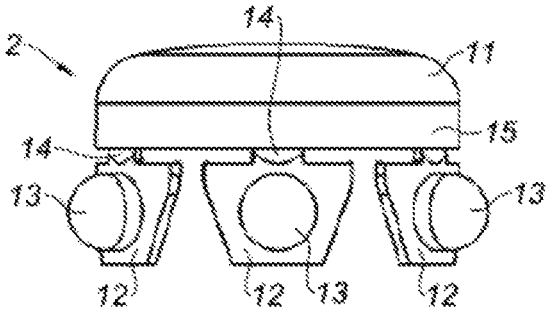
[Fig. 7]
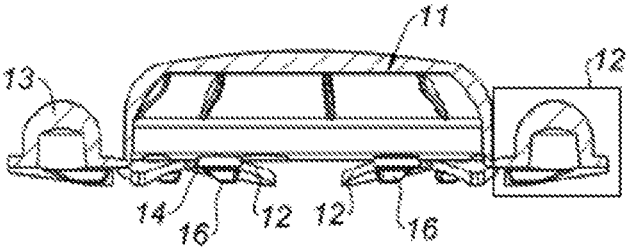
[Fig. 8]
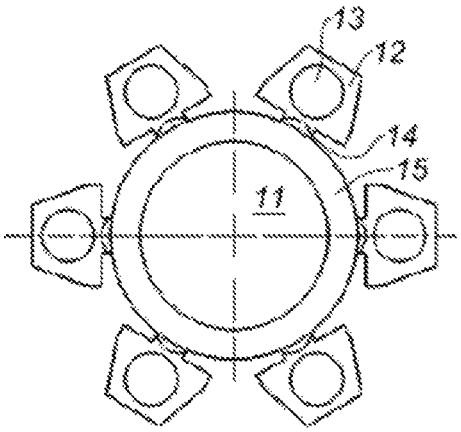

REMOVABLE CAP FOR A DISPENSING BOTTLE

CROSS REFERENCE TO RELATED APPLICATIONS

This application claims priority under 35 U.S.C. § 119(a) to French patent application number 1858680, filed on Sep. 24, 2018, the entire teachings of which are incorporated herein by reference.

BACKGROUND OF THE INVENTION

Field of the Invention

The invention relates to a removable cap for a dispensing bottle of a fluid product. The invention also relates to a dispensing bottle including such a cap. The invention finally relates to a method for producing a dome for such a cap. In the context of the invention, the fluid product is a cosmetic product, more specifically a perfume, an eau de toilette, or also a fragrance.

Description of the Related Art

Caps for bottles of cosmetic product are perceived by the user as elements for assessing the market value of the product, such that a cap of a certain weight and of a certain appearance will be associated with a perceived value. Therefore, it has been sought to weigh down and to embellish the caps of bottles of luxury products in order to satisfy the requirements of users concerning the perceived value of the product.

To weigh down the cap, it is common practice to integrate a weight made of a high-density material, such as steel or Zamak, inside the cap.

To embellish the cap, it is common practice to decorate it, the purpose also being to conceal the support of the cap or the weight, which are technical and ungainly elements, the sight of which is unacceptable for a luxury brand.

BRIEF SUMMARY OF THE INVENTION

The present invention aims to provide a removable cap for a dispensing bottle of a fluid product, having a sufficient weight, and decorated in a manner that is attractive to the user.

The cap according to the invention has a central axis X and includes, conventionally:

- an axis insert X being capable of concealing a dispensing system of the bottle, the insert including a peripheral portion and an upper portion;
- a first decorative element mounted on the insert and covering the peripheral portion of the insert;
- a second decorative element mounted on the insert and covering the upper portion of the insert, the second decorative element engaging with the first decorative element so as to integrate decorative protrusions within the first decorative element, arranged on the periphery of the cap, the decorative protrusions being arranged on a plurality of lugs.

The main idea of this invention consists in providing two decorations on the cap of the bottle. In this case, to decorate the cap, a first type of decoration is provided on the periphery and a second type of decoration is provided on the top. In addition to that, decorative protrusions are provided on the periphery, in order to provide the cap with texture and style. To be highlighted, these protrusions must be another colour and/or another material than that of the first decorative element. The idea is therefore to associate the protrusions with the second decorative element, which is designed in one colour and/or one material different from the first decorative element. The two decorative elements must therefore engage such that the protrusions of the second decorative element can pass through the first decorative element, so as to reach the periphery of the cap.

According to the different embodiments of the invention, which can be taken together or separately:

- the decorative protrusions are integrally formed with the second decorative element.
- the first decorative element consists of an X axis crown.
- the second decorative element consists of an X axis dome, with beads constituting the decorative protrusions.
- the crown has holes in which the beads of the dome are inserted.
- there are as many beads as holes.
- the dome includes a cap capping the crown, the cap having an end perimeter from which extends the plurality of lugs along a direction parallel to the X axis, the lugs being located inside the crown: the cap is thus visible to the user, and must be aesthetically irreproachable. The lugs themselves are concealed behind the peripheral wall of the crown, and are not visible to the user.
- the dome consists of one single part obtained by molding.
- the lugs are regularly distributed over the perimeter of the cap.
- each lug is attached to the perimeter of the cap via a film hinge.
- each lug has an inner face and an outer face, the outer face being provided with one of the beads extending along a radial direction: these beads are therefore inserted into the holes of the crown provided for this purpose. Thus, the lugs are concealed, apart from the beads that they support, which are visible and highlighted with respect to the crown. The beads are of the same colour and the same material as the cap.
- all the lugs are identical.
- the insert includes a main cylindrical body closed in the upper portion and open in the lower portion, defining a housing to receive the dispensing system, the lower portion extending by an annular return provided with crown fixing means. Any type of attachment can be considered. Preferably, the attachment is achieved by elastic interlocking.
- the cap includes a weight inserted between the main cylindrical body and the annular return of the insert.
- the weight exerts a force against the inner face of the lugs so as to push them back against the crown and make the beads enter into the holes. The weight thus ensures a radial clamping of the lugs against the side inner wall of the crown, thus maintaining the beads in the holes of the crown.
- the inner face of the lugs is provided with locking ribs against which the weight is in contact: the weight does not press directly on the inner face of the lug, but on the ribs, so as not to deform the lug and not to deform the beads.
- each inner face of the lugs is provided with two locking ribs arranged on either side of the bead: thus, the weight does not press on the rear zone of the bead, located on the inner face of the lug, so as to preserve the integrity of the bead by avoiding any deformation coming from the rear.

the main cylindrical body of the insert includes clamping ribs of the weight against the lugs of the dome: the weight is thus blocked between the insert and the lugs of the dome. There is no radial clearance.

The invention also relates to a dispensing bottle of a fluid product including a cap such as described above.

Finally, the invention relates to a method of producing a dome for a cap of a dispensing bottle of a fluid product.

As explained above, the dome includes a cap having an end perimeter from which extends, via film hinges, a plurality of lugs, each having a bead.

The method of producing such a dome includes the following steps:

flat molding of the dome, with the lugs oriented along a direction perpendicular to the central axis of the dome;

flat demolding of the dome;

folding back of the lugs along a direction parallel to the central axis of the dome.

Thus, the dome can be easily moulded with a mould without any mobile compartment-type molding. The idea of providing a film hinge between the lugs and the cap is absolutely original, as it makes it possible to flat mould the dome, i.e. with the lugs oriented perpendicularly to the central axis of the dome, instead of molding it in its final shape, i.e. with the lugs oriented parallel to the central axis of the dome.

In the case of a molding in its final shape, a mould would be provided, including several mobile compartment-type molding elements. Yet, the control of tooling investments and production costs imposes a maximum limitation of the number of parts in an industrial product and a simplification of the molding method. Hence the idea of the film hinges and flat molding.

Additional aspects of the invention will be set forth in part in the description which follows, and in part will be obvious from the description, or may be learned by practice of the invention. The aspects of the invention will be realized and attained by means of the elements and combinations particularly pointed out in the appended claims. It is to be understood that both the foregoing general description and the following detailed description are exemplary and explanatory only and are not restrictive of the invention, as claimed.

BRIEF DESCRIPTION OF THE SEVERAL VIEWS OF THE DRAWINGS

The accompanying drawings, which are incorporated in and constitute part of this specification, illustrate embodiments of the invention and together with the description, serve to explain the principles of the invention. The embodiments illustrated herein are presently preferred, it being understood, however, that the invention is not limited to the precise arrangements and instrumentalities shown, wherein:

FIG. 1 is an exploded view of a dispensing bottle of a fluid product according to the invention;

FIG. 2 is a side view of the bottle according to FIG. 1;

FIG. 3 is a longitudinal cross-sectional view of a cap of a bottle according to FIGS. 1 and 2;

FIG. 4 is a transversal cross-sectional view of the cap along the plane B-B of FIG. 3;

FIG. 5 is an enlarged view of a portion of the cap of FIG. 3, along another longitudinal cross-section corresponding to the plane C-C of FIG. 4;

FIG. 6 is a perspective view of a finished dome according to the invention;

FIG. 7 is a cross-sectional view of the flat dome, exiting from the molding step;

FIG. 8 shows a top view of the flat dome, exiting from the molding step.

DETAILED DESCRIPTION OF THE INVENTION

In reference to FIGS. 1 and 2, a dispensing bottle of a fluid product is shown according to the invention.

The fluid product is a cosmetic product, more specifically a perfume, an eau de toilette, or a fragrance.

This product is contained in a tank 9, topped by collar 10 in the upper portion, defining an upper opening in which a system for dispensing the product is inserted. This system conventionally includes a pump 8 being inserted in the upper opening. A pushbutton 6 is mounted on the pump 8 and makes it possible for the manual actuation thereof by a user. A band 7 is arranged around the emerging portion of the pump 8 which protrudes from the collar 10 of the tank 9, namely the dispensing head. This band 7 makes it possible to both conceal at least partially this dispensing head, and to ensure the long-term attachment of the pump 8 with respect to the collar 10 of the tank 9.

Indeed, this band 7 aims to conceal the most technical and ungainly aspects of the bottle, namely for example the spray pump 8, or the collar 10 of the tank 9. This band is usually force-mounted around the collar 10 of the tank 9.

Other dispensing systems could be considered.

To store perfume-type cosmetic products, it is common practice to use a rigid tank 9, for example made of glass. Perfumes being considered as luxury products, it is also common practice to provide a removable cap 1 being positioned on the dispensing head. High-end caps 1 are generally bulky, heavy, and have an elegant decoration on the periphery, which is therefore visible to the user. This relationship between the weight, the size, and the appearance, makes it possible to give a certain value to the cosmetic product.

The cap 1 according to the invention meets these three criteria. Indeed, it is relatively bulky, since it is at least as wide as the tank 9, it is relatively heavy, since it includes a weight 4 consisting of a high-density material, for example steel or Zamak, and it has an appealing appearance thanks to the engagement between two decorative elements, namely a crown 3 and a dome 2.

The crown 3 and the dome 2 form a crown, with a clamping of beads 13 over the whole periphery of the crown 3. The beads 13 are designed in the same material and in the same colour as the dome 2. Preferably, the crown 3 can be of a golden or silver colour.

To be able to maintain the crown 3, the dome 2 and the weight 4 in position, the cap 1 includes an insert 5 which is used as a support for all these parts. This insert 5 is also used to interlock the cap 1 on the band 7 of the dispensing system.

All the parts constituting the bottle are mounted along one single mounting axis X, coaxial with all the central axes of the parts.

As can best be seen in FIG. 3, this insert 5 includes a main cylindrical body 17 closed in the upper portion and open in the lower portion, defining a housing to receive the dispensing system. The insert 5 is interlocked in the band 7 of the dispensing system, by means of a peripheral grommet 22, protruding from the inner wall of the body 17 of the insert 5, being inserted inside a peripheral groove 23 provided for this purpose on the outer wall of the band 7, as illustrated in the enlarged view at the top-right of FIG. 3. The grommet 22 and the groove 23 have a concave and convex profile, making it possible for easy interlocking and release between the cap 1 and the band 7, when the user sinks the cap 1 onto the band 7 to close their perfume bottle and removes the cap 1 from the band 7 to be able to use their perfume bottle.

The lower portion of the insert 5 is extended by an annular return 18 provided with means for fixing the crown 3. Indeed, the insert 5 is, for example, snap-fitted in the crown 3. More specifically, as illustrated in the enlarged view at the bottom-right of FIG. 3, the annular return 18 of the insert 5 has a peripheral grommet 20, capable of being inserted inside a peripheral groove 21 provided for this purpose on the inner wall of the crown 3. The peripheral grommet 20 has a shoulder, just like the peripheral groove 21, such that the insert 5 can no longer be released from the crown 3 after the mounting thereof. After mounting, the crown 3 is thus axially blocked on the insert 5.

The insert 5 has an empty space between its main cylindrical body 17 and its annular return 18. In this empty space, the weight 4, featuring a hollow cylindrical shape, is housed. The latter is therefore maintained between the main cylindrical body 17 and the annular return 18 of the insert 5. The user perceives that the cap 1 has value, and therefore so has bottle when the cap 1 is quite heavy, thanks to the weight 4. The weight 4 can be made of "rolled" steel: a steel plate is cold-cut then rolled.

The dome 2 itself both covers the weight 4 and the insert 5, such that the user only sees the crown 3 and the dome 2 from the outside of the cap 1.

The dome 2 is interlocked in the crown 3 as will be described below.

As illustrated in FIG. 6, the dome 2 is mainly composed of a curved cap 11, having in the lower portion, an end perimeter 15 from which extends a plurality of lugs 12. This dome 2 has a central axis, passing through the centre of the cap 11. The lugs 12 extend parallel to this central axis. Each lug 12 is connected to the end perimeter 15 via a film hinge 14.

The lugs 12 are regularly distributed over the whole end perimeter 15. They are therefore arranged equidistantly from one another. Preferably, all the lugs 12 are identical. Each lug 12 has an outer face directed towards the crown 3, and an inner face directed towards the weight 4.

Each lug 12 includes, on its outer face, a decorative protrusion, such as a bead 13, integrally formed therewith for the clamping the crown 3. Indeed, the beads 13 used on the crown 3 belong to the dome 2. Each bead extends radially with respect to the dome. In an alternative embodiment, at least one lug includes more than one decorative protrusion.

The crown 3 has a plurality of through-holes 19, regularly distributed over the peripheral wall thereof. Each hole 19 is intended to receive a bead 13 of the dome 2. There are as many holes 19 in the crown 3 as beads 13 on the dome 2. The holes 19 are arranged on the crown 3 so as to correspond to the beads 13 arranged on the dome 2. The dome 2 is mounted on the crown 3, by making each bead 13 enter into a hole 19 of the crown 3. When all the beads 13 are inside the holes 19, the dome 2 is considered to be interlocked in the crown 3 and the two parts are maintained in position against one another.

The holes 19 are sized according to the size of the beads 13, and vice versa, so as to minimise the clearance between each bead 13 and its respective hole 19.

The lugs 12 can be of any shape. The width of the film hinge 14 is smaller than the width of the lugs 12, so as to allow for the best possible articulation of the lugs 12.

The weight 4 is used to exert a pressure against the lugs 12, in order to obtain a maximal insertion of the beads 13 inside the holes 19, and an optimal maintenance of the dome 2 in the crown 3. To exert this pressure without damaging and deforming the bead 13, the weight 4 does not bear directly against the inner face of the lug 12, but bears against two longitudinal ribs 16 extending from the inner face of the lug 12, and arranged on either side of the bead 13, as can in particular be seen in FIGS. 4 and 5. Thus, the weight 4 does not exert any pressure directly on the rear of the bead 13.

At the same time, for the weight 4 to exert this pressure on the lugs 12, the insert 5 exerts a radial clamping on the weight 4, thanks to the longitudinal ribs 24 extending from the outer face of the body 17 of the insert 5, as can clearly be seen in FIGS. 4 and 5. Preferably, there are six ribs 24 distributed over the periphery of the body 17 of the insert 5, in order to press on the weight 4 homogenously. Finally, the weight 4 is thus wedged between the body 17 of the insert 5 and the lugs 12, and more specifically, between the ribs 24 of the body 17 of the insert 5, and the ribs 16 of the lugs 12.

The dome 2 is preferably made of flexible plastic. It is made of one single part in a mould without any mobile compartment-type molding element. Indeed, as can be seen in FIGS. 7 and 8, the molding of the dome 2 is produced flat, i.e. with lugs 12 oriented orthogonally to the central axis of the dome 2. This flat molding makes it possible to use a mould with only one shell, instead of a mould with several shells with several compartments.

After demolding the dome 2, the lugs 12 can be lowered using the film hinges 14, such that they are oriented this time parallel to the central axis of the dome 2.

The configurations shown in the figures are examples of possible embodiments, and not limited thereto, the invention encompassing variants of shape and design that a person skilled in the art will be familiar with.

Of note, the terminology used herein is for the purpose of describing particular embodiments only and is not intended to be limiting of the invention. As used herein, the singular forms "a", "an" and "the" are intended to include the plural forms as well, unless the context clearly indicates otherwise. It will be further understood that the terms "includes" and/or "including," when used in this specification, specify the presence of stated features, integers, steps, operations, elements, and/or components, but do not preclude the presence or addition of one or more other features, integers, steps, operations, elements, components, and/or groups thereof.

As well, the corresponding structures, materials, acts, and equivalents of all means or step plus function elements in the claims below are intended to include any structure, material, or act for performing the function in combination with other claimed elements as specifically claimed. The description of the present invention has been presented for purposes of illustration and description, but is not intended to be exhaustive or limited to the invention in the form disclosed. Many modifications and variations will be apparent to those of ordinary skill in the art without departing from the scope and spirit of the invention. The embodiment was chosen and described in order to best explain the principles of the invention and the practical application, and to enable others of ordinary skill in the art to understand the invention for various embodiments with various modifications as are suited to the particular use contemplated.

Having thus described the invention of the present application in detail and by reference to embodiments thereof, it will be apparent that modifications and variations are possible without departing from the scope of the invention defined in the appended claims as follows:

The invention claimed is:

1. A removable cap for a dispensing bottle of a fluid product, provided with a central axis, and comprising:

an axis insert capable of concealing a dispensing system of the bottle, said insert comprising a peripheral portion and an upper portion;

a first decorative element mounted on the insert and covering the peripheral portion of the insert;

a second decorative element mounted on the insert and covering the upper portion of the insert, said second decorative element engaging with said first decorative element so as to integrate decorative protrusions within the first decorative element, arranged on the periphery of the cap, said decorative protrusions being arranged on a plurality of lugs.

2. The cap according to claim 1, wherein said decorative protrusions are integrally formed with the second decorative element.

3. The cap according to claim 1, wherein said first decorative element consists of an axis crown.

4. The cap according to claim 3, wherein the second decorative element consists of an axis dome, equipped with beads constituting said decorative protrusions.

5. The cap according to claim 4, wherein said crown has holes in which the beads of the dome are inserted.

6. The cap according to claim 5, wherein there are as many beads as holes.

7. The cap according to claim 4, wherein said dome comprises a crown cap capping the crown, said crown cap having an end perimeter from which extends said plurality of lugs along a direction parallel to the axis, said lugs being located inside the crown.

8. The cap according to claim 7, wherein each lug is attached to the perimeter of the crown cap via a film hinge.

9. The cap according to claim 7, wherein each lug has an inner face and an outer face, said outer face being provided with one of said beads extending along a radial direction.

10. The cap according to claim 7, wherein the insert comprises a main cylindrical body closed in the upper portion and open in the lower portion, defining a housing to receive the dispensing system, said lower portion extending by an annular return provided with means for fixing the crown.

11. The cap according to claim 10, wherein the cap further comprises a weight inserted between the main cylindrical body and the annular return of the insert.

12. The cap according to claim 11, wherein said weight exerts a force against the inner face of the lugs so as to push them back against the crown and to make the beads enter into the holes.

13. The cap according to claim 12, wherein the inner face of the lugs is provided with locking ribs with which the weight is in contact.

14. The cap according to claim 13, wherein the main cylindrical body of the insert comprises ribs for clamping the weight against the lugs of the dome.

15. A dispensing bottle of a fluid product comprising:

a bottle; and, a cap, the cap comprising:

an axis insert capable of concealing a dispensing system of the bottle, said insert comprising a peripheral portion and an upper portion;

a first decorative element mounted on the insert and covering the peripheral portion of the insert;

a second decorative element mounted on the insert and covering the upper portion of the insert, said second decorative element engaging with said first decorative element so as to integrate decorative protrusions within the first decorative element, arranged on the periphery of the cap, said decorative protrusions being arranged on a plurality of lugs.

16. A method for producing a second decorative element of a cap for a dispensing bottle, said cap comprising an axis insert capable of concealing a dispensing system of the bottle, said insert comprising a peripheral portion and an upper portion, a first decorative element mounted on the insert and covering the peripheral portion of the insert, a second decorative element mounted on the insert and covering the upper portion of the insert, said second decorative element engaging with said first decorative element so as to integrate decorative protrusions within the first decorative element, arranged on the periphery of the cap, said decorative protrusions being arranged on a plurality of lugs, said second decorative element consisting of an axis dome comprising a dome cap having an end perimeter from which extends, via film hinges, a plurality of lugs each having a bead corresponding to a decorative protrusion, the method comprising:

flat moulding the dome, with the lugs oriented along a direction perpendicular to the central axis of the dome;

flat demoulding the dome; and, folding back the lugs along a direction parallel to the central axis of the dome.

* * * * *